United States Patent [19]

Junkers

[11] Patent Number: 4,663,997

[45] Date of Patent: May 12, 1987

[54] FLUID-OPERATED WRENCH

[76] Inventor: John K. Junkers, 7 Arrowhead La., Saddle River, N.J. 07458

[21] Appl. No.: 818,819

[22] Filed: Jan. 14, 1986

[51] Int. Cl.[4] ..... B25B 13/46

[52] U.S. Cl. ..... 81/57.39; 81/57.3; 81/57.34

[58] Field of Search ..... 81/57.39, 57.3, 55, 81/57.15, 57.19, 57.34, 57.36, 57.16

[56] References Cited

U.S. PATENT DOCUMENTS 4,346,630 8/1982 Hanson ..... 81/57.39

4,372,181 2/1983 Tinsley ..... 81/57.39

FOREIGN PATENT DOCUMENTS 130465 1/1985 European Pat. Off. ..... 81/57.39

*Primary Examiner*—Frederick R. Schmidt

*Assistant Examiner*—Bradley I. Vaught

*Attorney, Agent, or Firm*—Michael J. Striker

[57] ABSTRACT

A fluid-operated wrench, comprises at least one cylinder-piston unit having an axis and including a cylinder and a piston provided with a piston rod and movable together with the latter in axial direction, the piston rod having a free end operative for engaging one object, and a linkage connected with the cylinder and having a free end portion which is operative for engaging another object, so that when the one object is stationary while the other object a turnable threaded connector and the free end of the piston rod is brought into abutment against the one stationary object and then extended, the linkage is turned and thereby the free end portion of the linkage turns the turnable threaded connector, the linkage extending from the cylinder substantially in the axial direction.

13 Claims, 11 Drawing Figures

FIG. 4
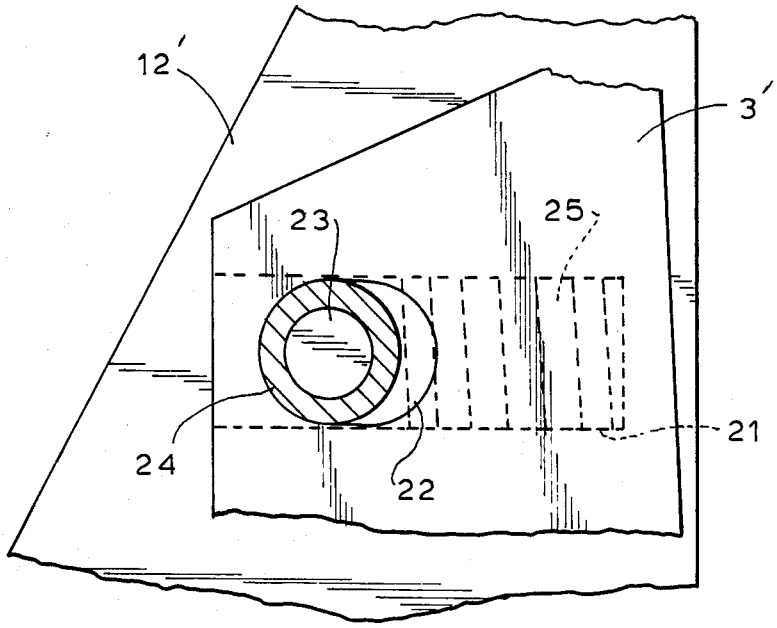
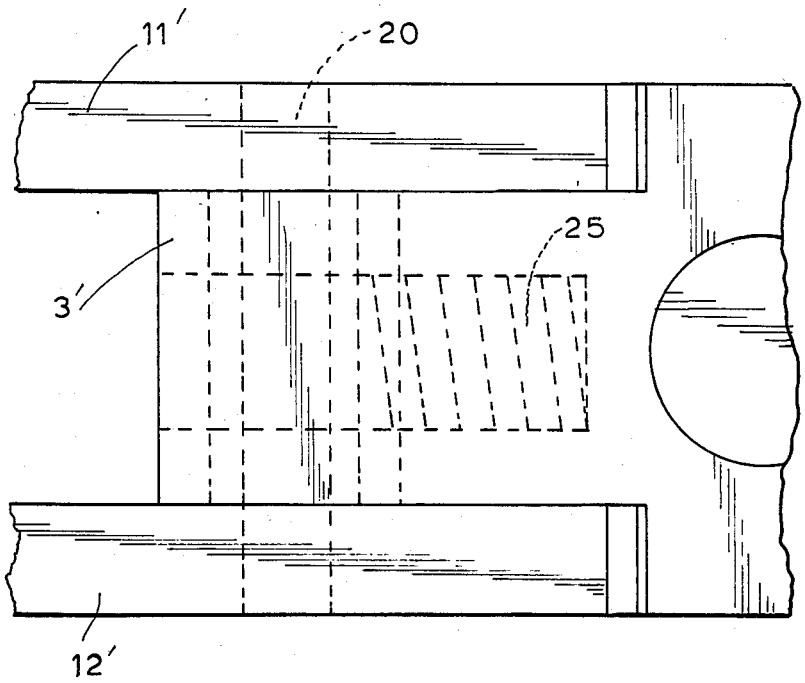
FIG. 4A

FLUID-OPERATED WRENCH

BACKGROUND OF THE INVENTION

The present invention relates to a fluid-operated wrench for tightening or loosening threaded connectors.

Fluid-operated wrenches of the mentioned general type are known in the art. Some of these fluid-operated wrenches are disclosed, for example in my U.S. Pat. Nos. 4,079,641 or 4,386,727, or in the DE-OS No. 3,113,482. These hydraulic wrenches have a wrench body provided with a cylinder-piston unit, and a link connected with the body and arranged to engage a polygonal head of a threaded connector. When the body abuts against an adjacent object, such as for example an adjacent nut, a flange or the like. and the cylinder-piston unit is actuated. the link is turned by the cylinder-piston unit and, in turn, turns the threaded connector for tightening or loosening the latter. In all known fluid-operated wrenches the link extends transverse to the cylinder-piston unit. Because of this the wrench is relatively complicated to manufacture, and the link is relatively high and therefore poses some problems in limited clearance areas. In the wrenches which are used as limited clearance-type tools, the thickness of a ratchet which is mounted on the link makes it impossible to use lever plates and housing plates in addition. When only lever plates are used and when the lever plates have to be moved around the center of a ratchet axis, the mechanism become extremely complicated.

SUMMARY OF THE INVENTION

Accordingly, it is an object of the present invention to provide a fluid-operated wrench which eliminates the disadvantages of the prior art.

In keeping with these objects and with others which will become apparent hereinafter, one feature of the present invention resides, briefly stated, in a fluid-operated wrench which has at least one cylinder-piston unit with a cylinder and a piston provided with a piston rod and movable together with the latter in an axial direction, and links means connected with the cylinder and extending from the latter substantially in an axial direction of the cylinder-piston unit.

When the piston rod engages with its free end an adjacent stationary object, and a free end portion of the link means engages another object for example a threaded connector, upon actuation of the cylinder-piston unit the piston rod is extended and the entire tool with the cylinder-piston unit and the link means is turned so that the free end portion of the links means turns the threaded connector.

Since the link means extends substantially in the axial direction of the cylinder-piston unit, the wrench is extremely simple to manufacture and the link height can be kept down to a minimum for clearance purposes.

The fluid-operated wrench in accordance with the invention can be ueed in a somewhat different manner. The free end portion of the link means can engage the other object which is stationary, while the end of the piston rod in extended condition abuts against a threaded connector which is turnable and prevents the threaded connector from turning. This can be done in order to prevent turning of a bolt head at the opposite axial end of the bolt, when its nut is being tightened or loosened.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 4 is a view showing a fragment of the fluid-operated wrench of FIG. 3, on an enlarged scale;

FIG. 4*a* is a plan view of FIG. 4

DESCRIPTION OF THE PREFERRED EMBODIMENTS

Figure 1:
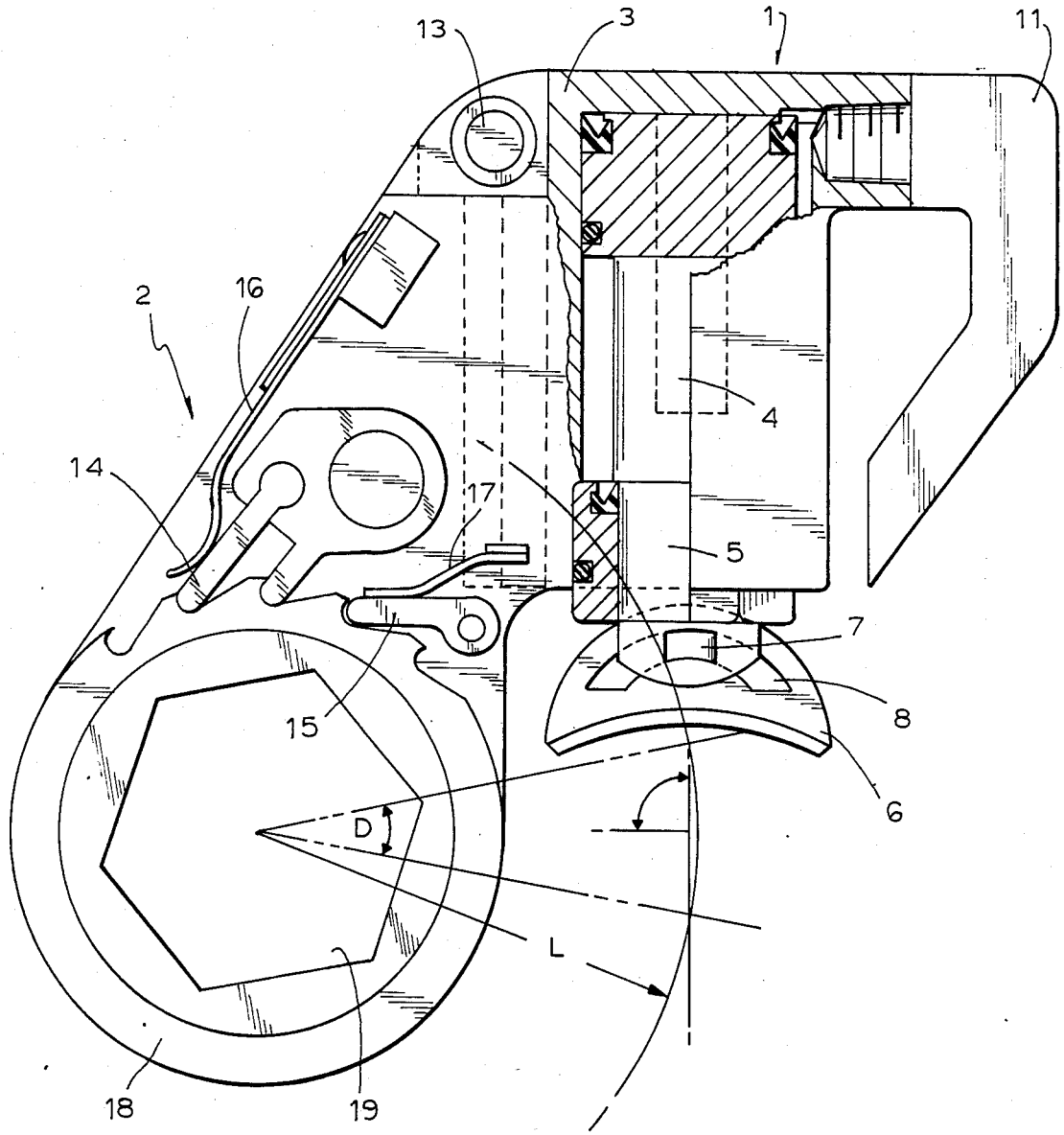
FIG. 1 is a side view of a fluid-operated wrench in accordance with one embodiment of the invention.
Figure 1A:
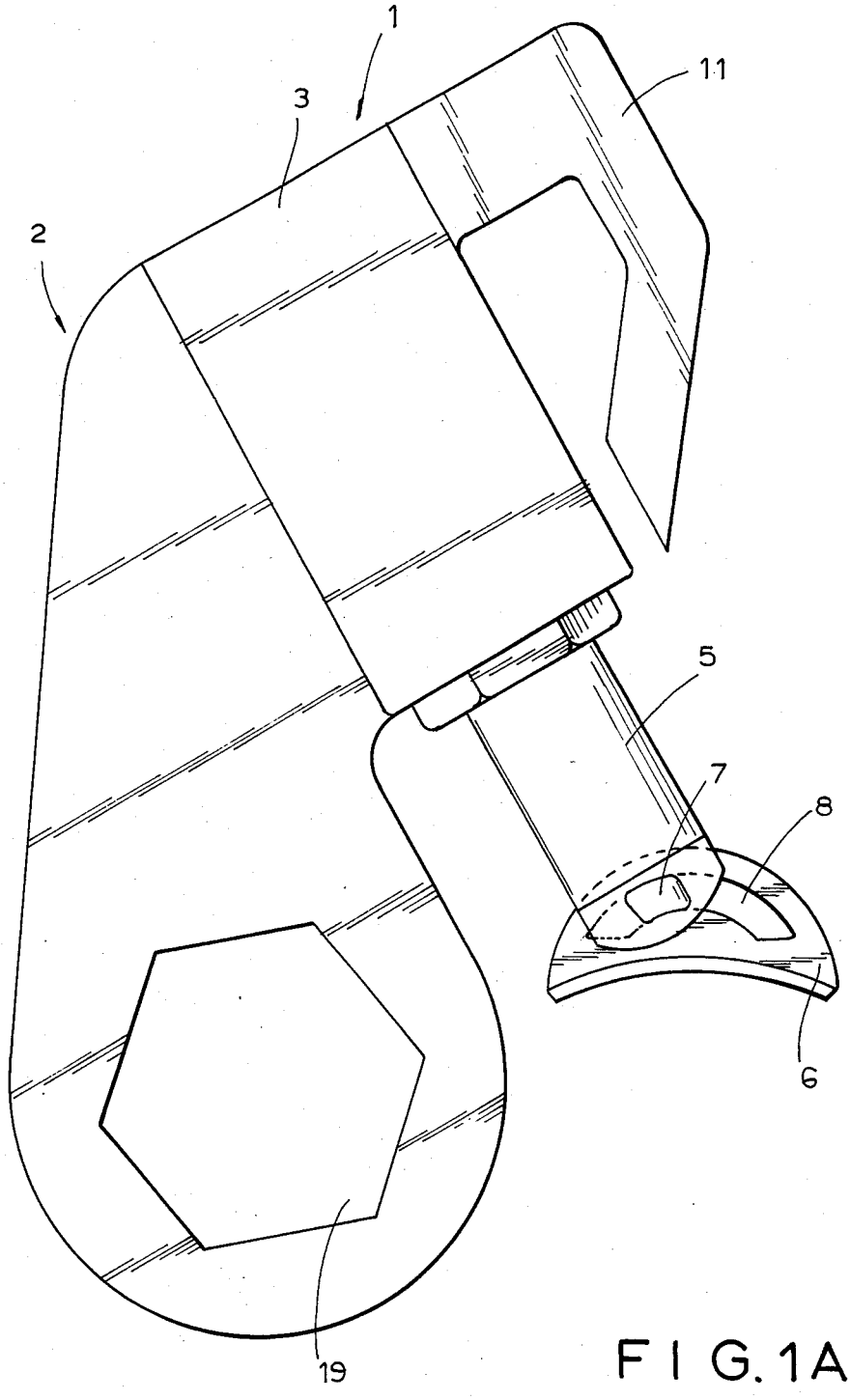
FIG. 1*a* is a view showing the fluid-operated wrench of FIG. 1 after turning of a threaded connector.
Figure 2:
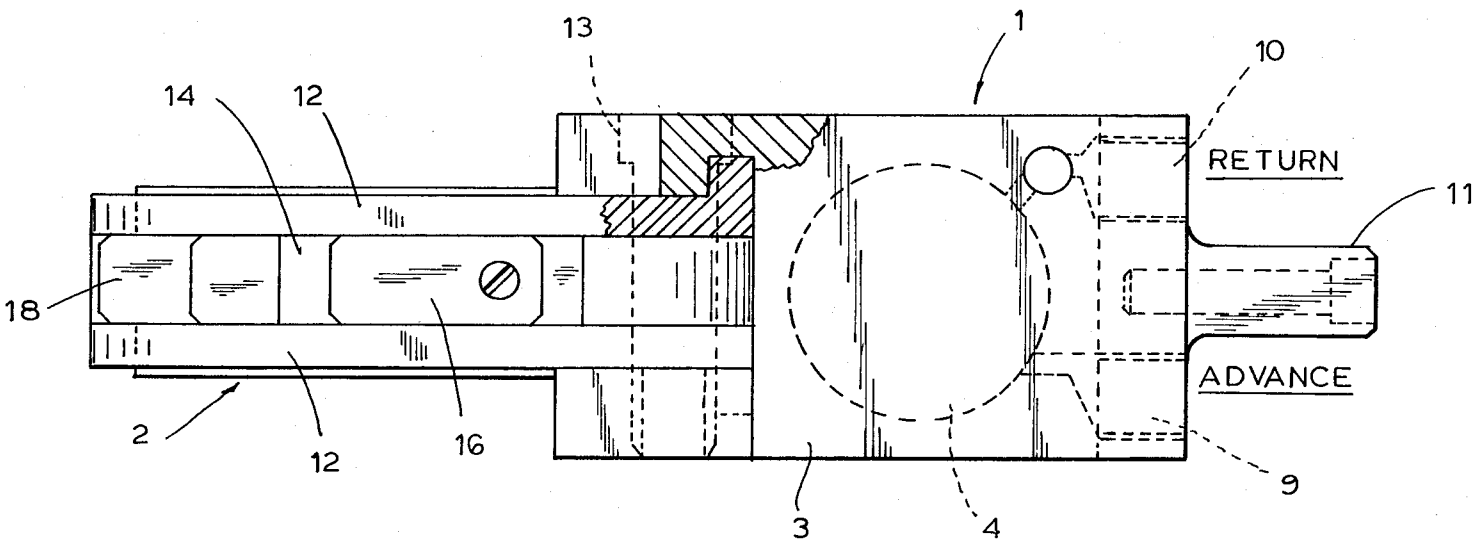
FIG. 2 is a plan view of the fluid-operated wrench of FIG. 1.

A fluid-operated wrench in accordance with the embodiment shown in FIGS. 1 and 2 has a cylinder-piston unit which is identified with reference numeral 1 and link means identified with reference numeral 2. The cylinder-piston unit has a cylinder 3 which forms a cylinder chamber, and a piston 4 which is movable in the cylinder chamber and is provided with a piston rod 5. A reaction member 6 is connected with the free end of the piston rod 5 turnably relative to the latter, about an axis which extends transversely to the direction of movement of the piston 4. This connection can be performed by means of a cooperating pin 7 extending through the piston rod 5 and an arcuate slot 8 provided in the reaction member 6. The cylinder has a fluid inlet 9 and a fluid outlet 10. A tool handle 11 is connected with the cylinder 3 of the cylinder-piston unit 1.

The link means 2 has two link plates 12. A left portion of the cylinder 3 extends into the space between the link plates 12 and is connected with the latter, for example by means of a pin 13. In the embodiment shown in FIGS. 1 and 2 the cylinder-piston unit 1 and the link means 2 are immovable relative to one another. As can be clearly seen from FIG. 1 the link means 2 or their link plates 12 extend from the cylinder 3 of the cylinder-piston unit 1 not transversely to the axis of the cylinder-piston unit, as in conventional fluid-operated wrenches, but instead the link means 2 or its link plates 12 extend substantially in the axial direction of the cylinder-piston unit. Even from visual consideration of FIG. 1 it can be clearly recognized that the height of the link means is kept to a minimum. The term "axial direction" is used here to identify that the link means 2 extend either parallel to the axis of the cylinder-piston unit or at a very small angle. Two driving pawls 14 and 15 are connected with the plates 12 and held under the action of springs 16 and 17 respectively. The driving pawls 14 and 15 cooperate with teeth of a ratchet wheel 18 which is turnably mounted on a free end of the link plates 12. As can be seen from FIG. 1 a hexagonal opening is provided in the ratchet wheel 18 for engaging a hexagonal nut or bolt head. It is to be understood that a standard socket for example with a square opening, or other engaging element can be inserted in the ratchet wheel 18.

The operation of the fluid-operated wrench in accordance with FIGS. 1 and 2 is as follows:

When the hexagonal opening 19 of the ratchet wheel 18 is fitted on a hexagonal nut of a threaded connector and the reaction member 6 abuts against an adjacent object, the cylinder-piston unit 3 is actuated and the piston rod 5 is extended thus pushing the entire wrench in a counterclockwise direction. The driving pawl 14 turns the ratchet wheel 18 and therefore the threaded connector in the counterclockwise direction. When then the piston rod 5 is retracted, the entire wrench is turned in a clockwise direction, the driving pawl 14 slips over the respective teeth, while the driving pawl 15 turns the ratchet wheel 18 and thereby the threaded connector again in the counterclockwise direction.

Figure 3:
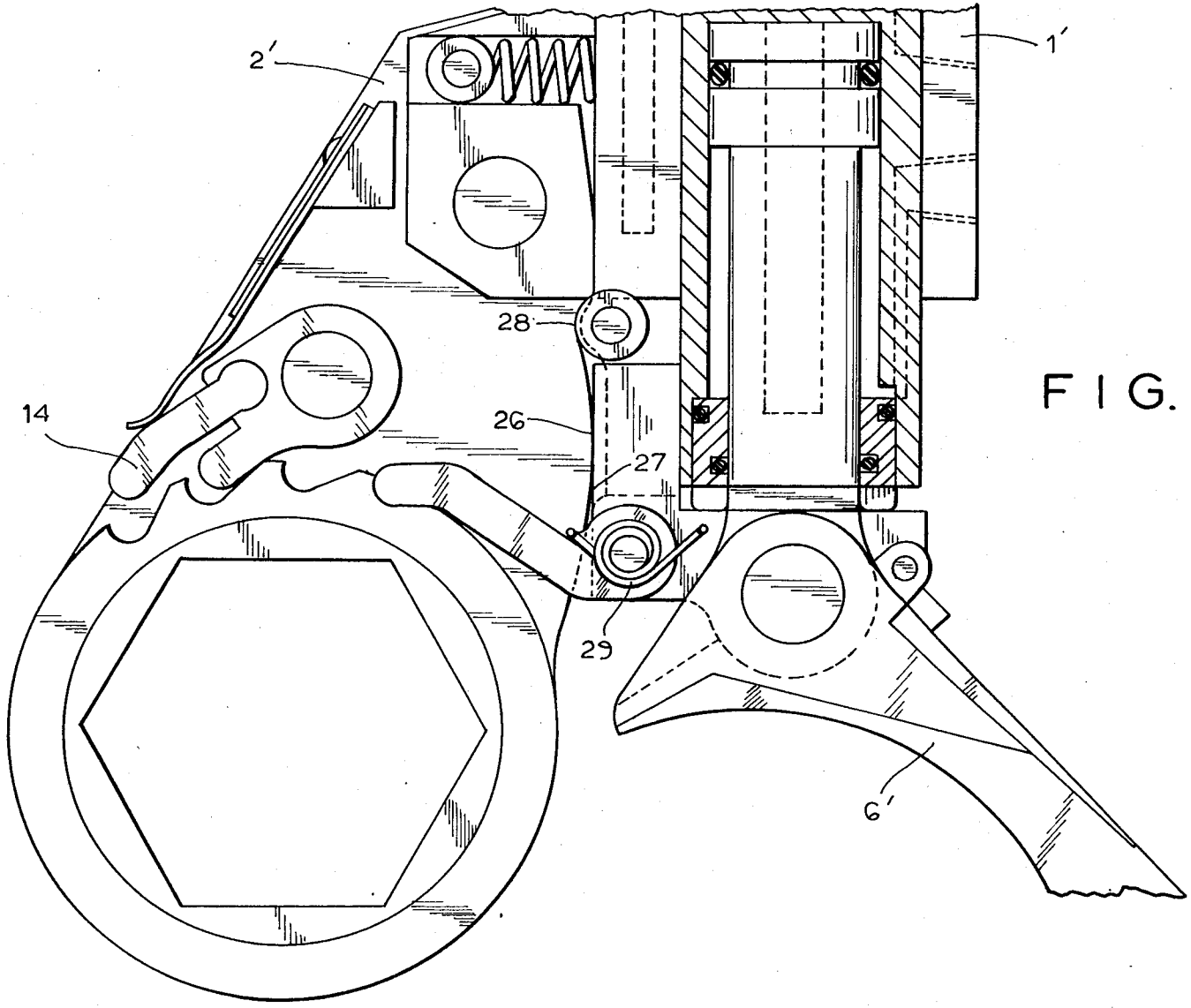
FIG. 3 is side view of a fluid-operated wrench in accordance with another embodiment of the invention.

The fluid-operated wrench shown in FIGS. 3 and 4 has a cylinder-piston unit 1' and link means 2' with the link means 2' extend1ng again substantially in the axial direction of the cylinder-piston unit. However, in this embodiment the link means 2' is turnable relative to the cylinder-piston unit 1'. Link plates 12' are provided with openings 20, while the end portion of the cylinder 3 is provided with an elongated blind hole 21 and a transverse opening 22 which is somewhat elongated in the direction of the elongation of the hole 21. A pin 23 which can have a roller 24 extends through the elongated opening 22 in the cylinder 3' and the openings 20 in the plates 12'. A spring 25 arranged in the blind hole 21 spring-biases the pin 28. The link plates 12' have a guiding surface 26 which cooperates with a guiding surface 27 of the cylinder 3', and a roller 28 can also be provided for cooperation with the guiding surface 26. A helical spring 29 has one end which is connected to the link plates 12', and another end which is connected with the cylinder 3.

The fluid-operated wrench shown in FIGS. 3 and 4 operates in the following manner. When the inner opening of the ratchet wheel is fitted on a threaded connector and a reaction member 6' abuts against an adjacent object, the piston rod is extended and the cylinder 3' is turned in a counterclockwise direction and thereby also turns the link means 2' or their link plates 12' so as to turn the ratchet wheel in a counterclockwise direction by the driving pawl 14. During the return stroke of the piston rod the ratchet wheel is turned by the driving pawl 15. During forward and return strokes, a relative movement between the cylinder 3' and the link plates 12' takes place so that the reactor member 6' does not move from the point of its abutment. During the extension of the piston rod the spring 25 is compressed and the spring 29 is stretched, while during the retraction of the piston rod the spring 25 pushes the upper portion of the cylinder 31 and the spring 29 pulls the lower portion of the cylinder 3' to 1ts initial position.

Figure 5:
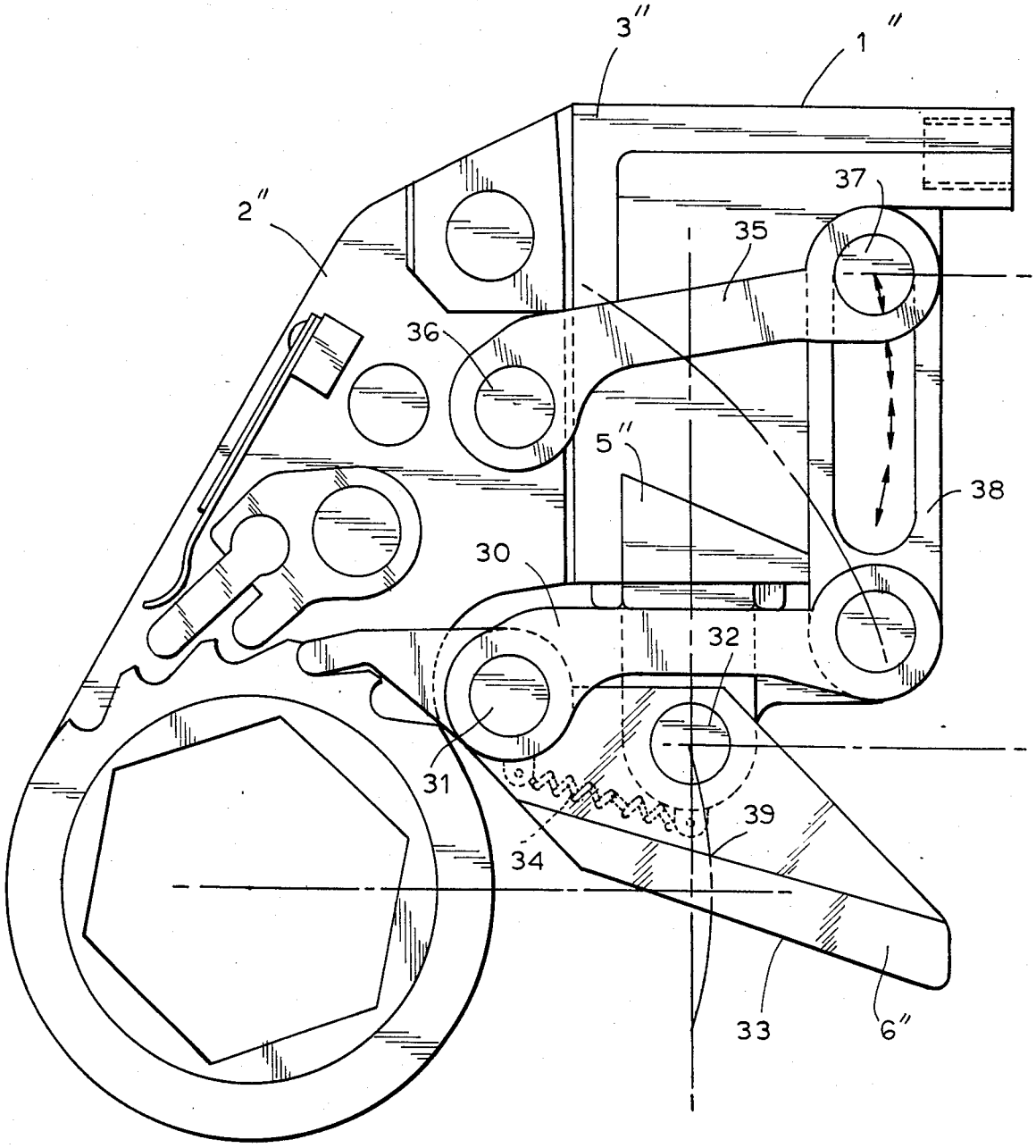
FIG. 5 is a side view of a fluid-operated wrench in accordance with a further embodiment of the invention.
Figure 6:
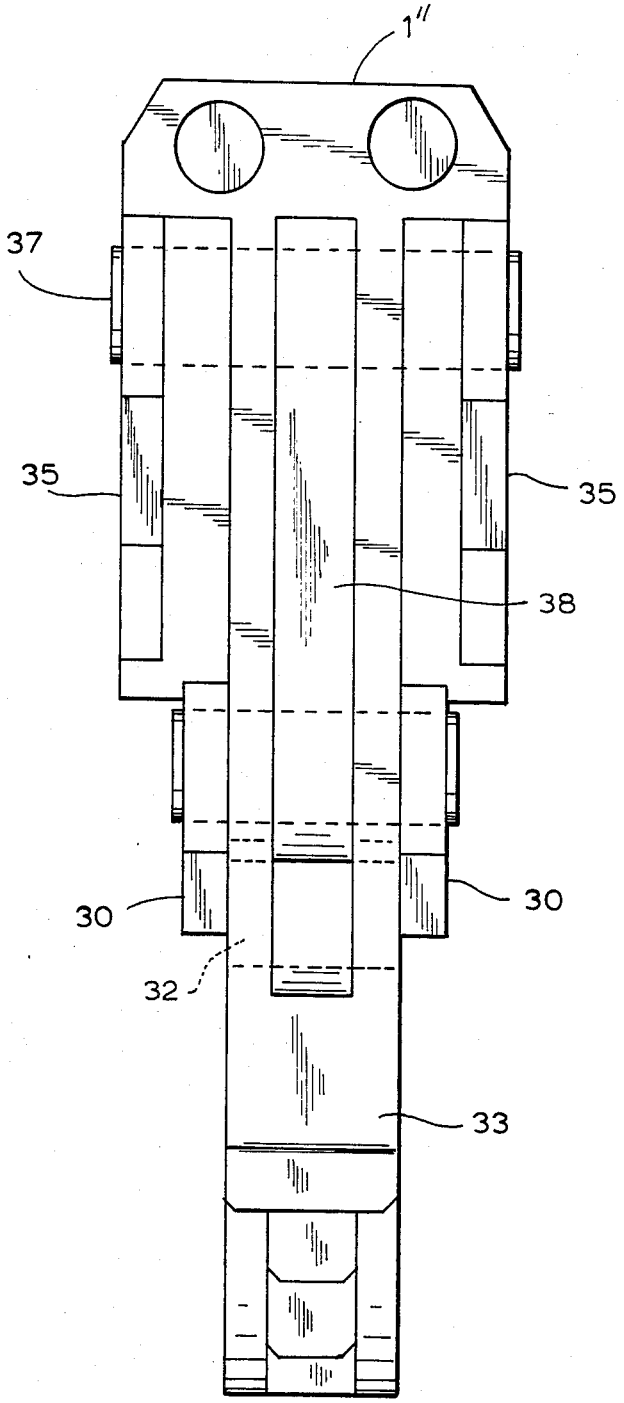
FIG. 6 is rear view of the fluid-operated wrench of FIG. 5.

FIGS. 5 and 6 show the fluid-operated wrench in accordance with a further embodiment of the invention. A reaction member 6'' of the wrench of this embodiment is pivotally connected at its one end with a lever 30 by a pivot pin 31, and is also pivotally connected in its central area with a piston rod 5'' by a pivot pin 32. The opposite end of the lever 30 is pivotally connected with the cylinder 3'' of the cylinder-piston unit. The lever 30 includes two lever members arranged at both sides of the reaction member 6''. In this construction during extension and retraction of the piston rod 5'' an abutment area 33 of the reaction member 6'' between its front portion A and its rear portion B moves over an angle which exactly corresponds to the angle of turning of the entire wrench. As can be seen from the drawing, a spring 34 connects the left end of the lever 30 with the lower end of the piston rod 5'' for returning the lever system to its initial position.

As can also be seen from FIG. 5 an arc adjusting lever is further provided. Its one end is pivotally connected with the link means 2' by a pivot 36, while its another end slides by means of a pin 37 in a slider 38. The slider 38 has an opposite end which is fixedly connected to the piston rod 5'' of the cylinder-piston unit. Similarly to the embodiment of FIGS. 3 and 4, here the link means 2' is somewhat turnable relative to the cylinder-piston unit 1''. During the extension and retraction of the piston rod 5'' the pivot pin 36 is forcedly displaced to the left and to the right relative to the cylinder-piston unit 1'' so that the cylinder 3'' moves along the arc 39, instead of moving along a straight line. As can clearly be seen from the drawing, the lever 35 includes two lever members arranged at both sides of the cylinder 3''.

Figure 7:
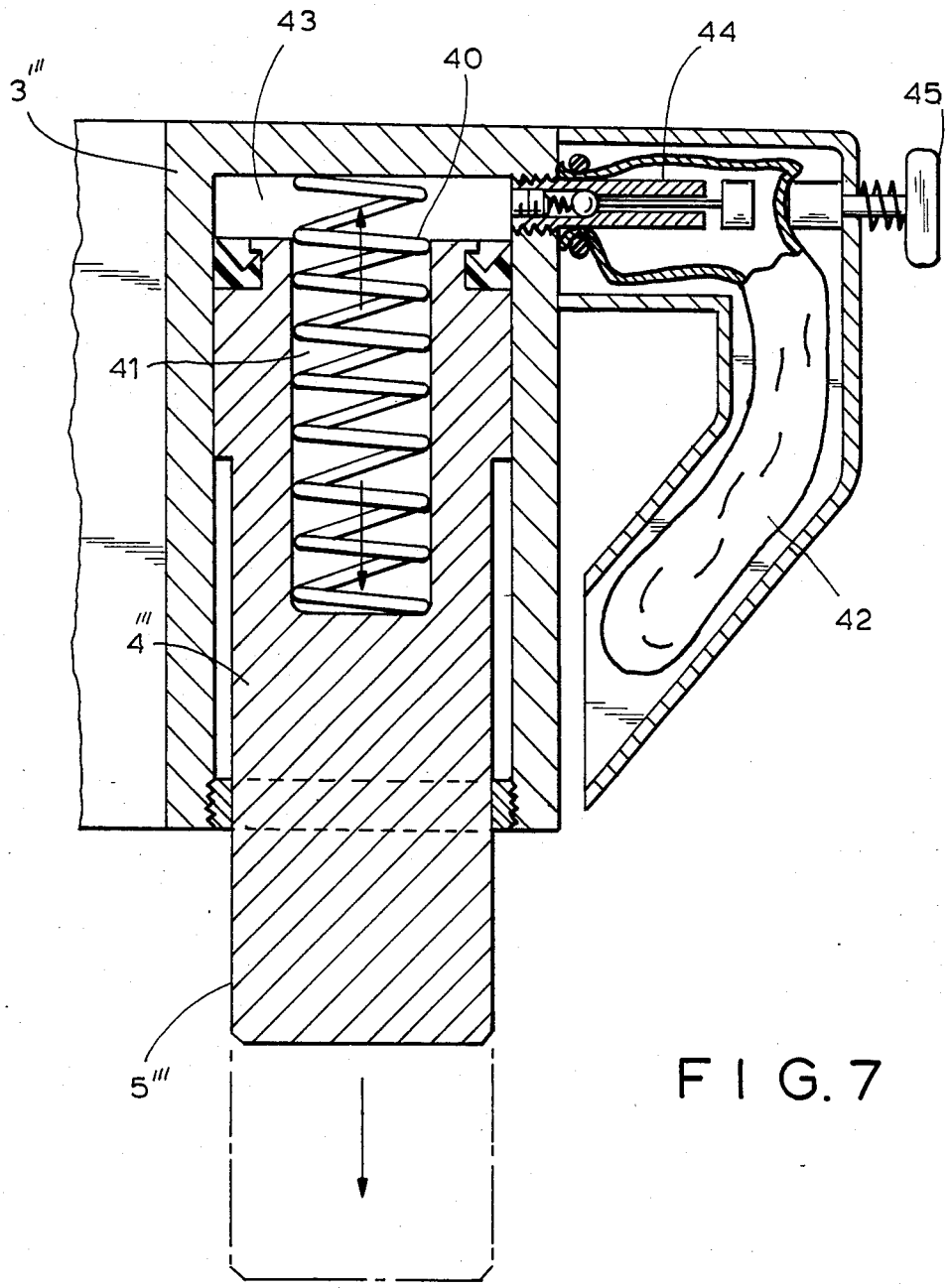
FIG. 7 is a view showing a further embodiment of the inventive fluid-operated wrench.

FIG. 7 shows a somewhat different use of the inventive fluid-operated wrench. A spring 40 spring-biases a piston rod 5''' to its extended position. It is arranged partially in a spring chamber 41 and abuts with its ends against facing surfaces of the cylinder 3''' and a piston 4'''. A bladder 42 is filled with oil or another medium and is in operative communication with a cylinder chamber 43 via a valve 44 which has a valve button 45. A left part of the wrench which can be provided with a ratchet wheel or can be formed without the same engages an adjacent object, while the free end surface of the piston rod 5''' is brought in abutment against a threaded connector, for example a a bolt head of a bolt. The free end surface of the piston rod 5''' is firmly held against the bolt head under the action of the spring 40 and oil admitted from the bladder 42 into the cylinder chamber 43 and spring chamber 41. When for example a nut is turned at its opposite end for tightening or loosening, the bolt head is firmly held by the free end surface of the piston rod 5''' and therefore the bolt turn. For releasing the wrench, the valve button is actuated and the oil is discharged back into the bladder 42. The tool can be released by overcoming the pressure of the spring 40.

Figure 8:
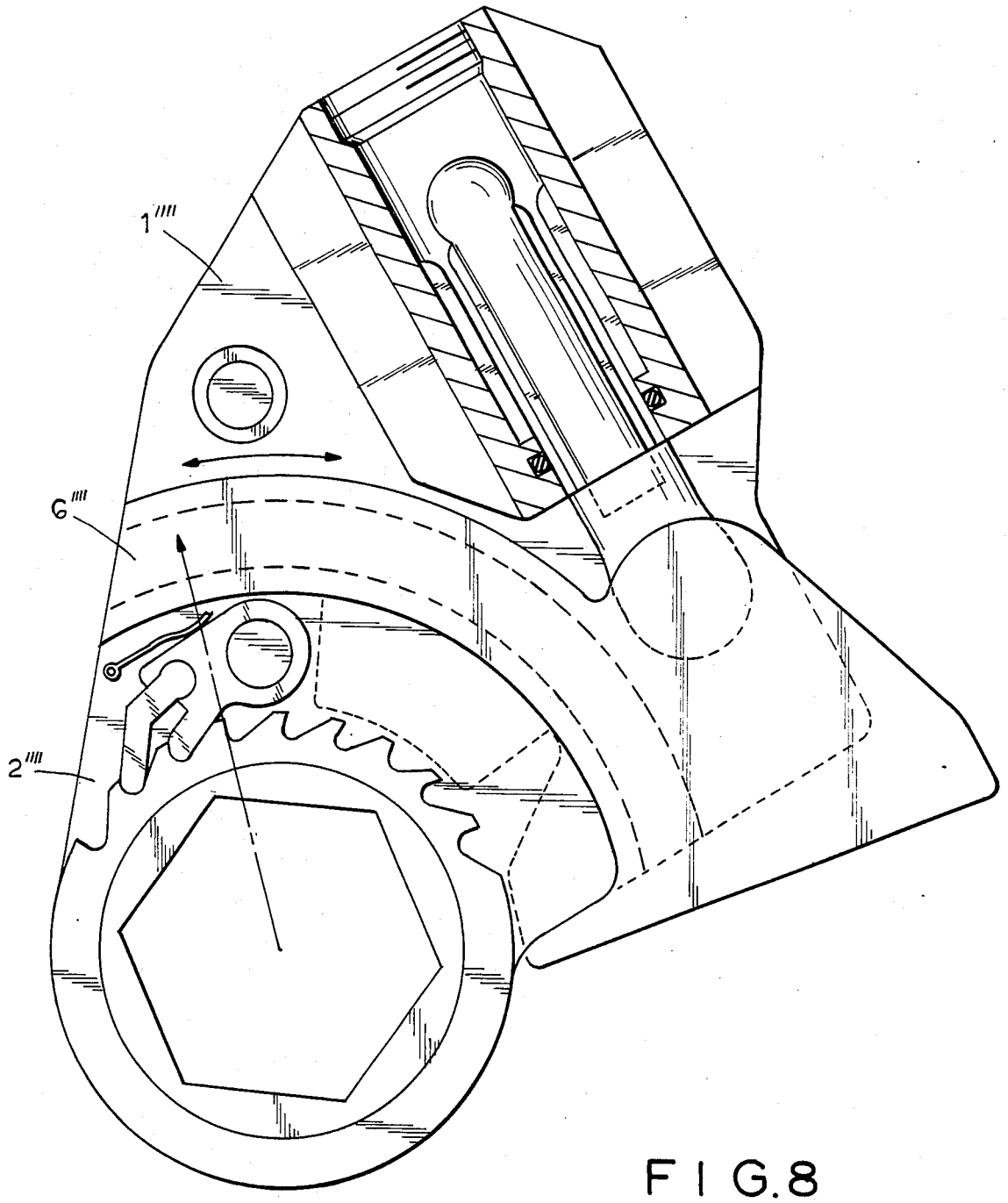
FIG. 8 is a view showing still a further embodiment of the inventive fluid-operated wrench.
Figure 9:
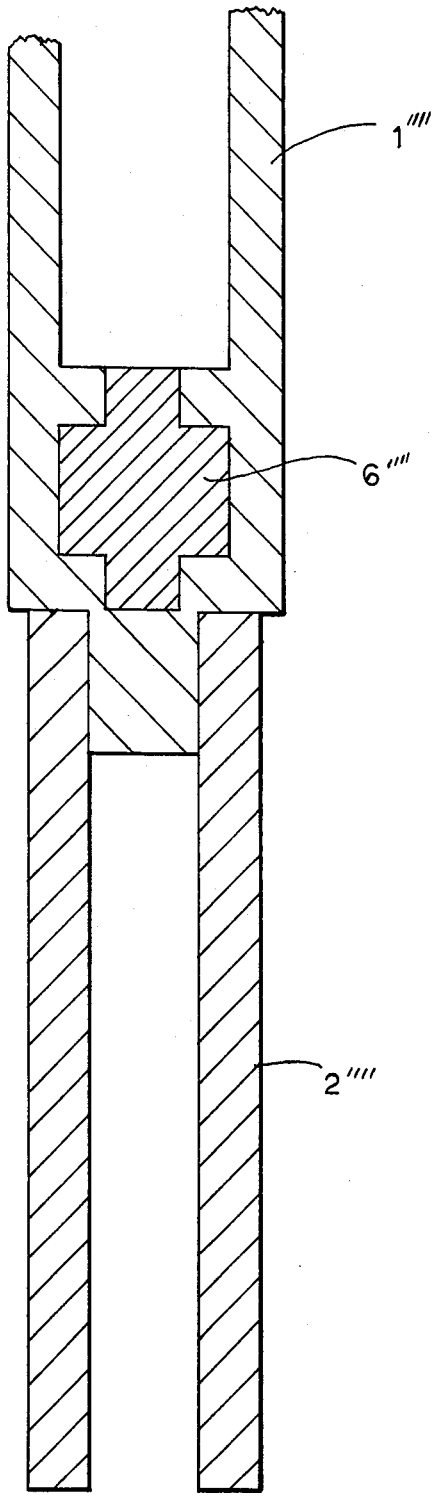
FIG. 9 is a partial cross section of FIG. 8.

In the embodiment shown in FIGS. 8 and 9 the cylinder-piston unit 1'''' is fixedly connected with the link means 2''''. A reaction member 6'''' is guided in a guiding slot extending over a circumference around the threaded connector with a center in the center of the ratchet wheel so that during the entire forward and backward strokes the abutment area of the reaction member 6'''' does not change its position relative to the stationary ajacent object.

It will be understood that each of the elements described above, or two or more together, may also find a useful application in other types of constructions differing from the types described above.

While the invention has been illustrated and described as embodied in a fluid-operated wrench, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A fluid-operated wrench, comprising at least one cylinder-piston unit having an axis and including a cylinder and a piston provided with a piston rod and movable together with the latter in axial direction, said piston rod having a free end operative for engaging one object; and link means connected with said cylinder, said link means having a free end portion which is operative for engaging another object, the one object is stationary while the other object is a turnable threaded connector when said free end of said piston rod is brought into abutment against the one stationary object and then extended, said link means is turned and thereby said free end portion of said link means turns the turnable threaded connector, said link means extending from said cylinder substantially in the axial direction.

2. A fluid-operated wrench, comprising at least one cylinder-piston unit having an axis and including a cylinder and a piston provided with the piston rod and movable together with the latter in an axial direction, said piston rod having a free end operative for engaging one object; and link means connected with said cylinder, said link means having a free end portion which is operative for engaging another object, said free end of said piston rod and said free end portion of said link means being formed so that when the other object is stationary while the one object is a turnable threaded connector and said free end portion of said link means engages the other stationary object, said end of said piston rod in extended condition of said piston rod abuts against the turnable threaded connector and therefore prevents turning of the latter, said link means extending from said cylinder substantially in the axial direction.

3. A fluid-operated wrench as defined in claim 1, wherein said cylinder-piston unit and said link means are fixedly connected with one another so that said cylinder-piston unit turns together with said link means during extension and retraction of said piston rod.

4. A fluid-operated wrench as defined in claim 1, wherein said link means is turnably connected with said cylinder-piston unit so as to allow a relative movement between the former and the latter during extension and retraction of said piston rod; and further comprising means for turnably connecting said link means with said cylinder-piston unit so as to allow said relative movement.

5. A fluid-operated wrench as defined in claim 1; and further comprising a reaction member connected with said piston rod and arranged to directly abut against said one object.

6. A fluid-operated wrench as defined in claim 5, wherein said reaction member is pivotally connected with said free end of said piston rod; and further comprising means for pivotally connecting said reaction member with said free end of said piston rod.

7. A fluid-operated wrench as defined in claim 1, wherein said link means is turnably connected with said cylinder-piston unit so as to allow a relative movement between said link means and said cylinder-piston unit during extension and retraction of said piston rod; and further comprising spring means arranged between said link means and said cylinder-piston unit and operative for restoring an initial position of said link means relative to said cylinder-piston unit during the retraction of said piston rod.

8. A fluid-operated wrench as defined in claim 4, and further comprising a reaction member which is pivotally mounted on said free end of said piston rod and having an abutment surface arranged to directly abut against said one object; and lever means pivotally connecting said reaction member with said cylinder-piston unit so that during extension and retraction of eaid piston rod said abutment surface of said reaction member turns over an angle which corresponds to the angle of turning of said link means.

9. A fluid-operated wrench as defined in claim 8, wherein said reaction member has a central portion which is pivotally connected with said free end of said piston rod and an end portion, said lever means including a lever which has one end pivotally connected with said end portion of said reaction member and another end which is pivotally connected with said cylinder-piston unit.

10. A.fluid-operated wrench as defined in claim 4; and further comprising lever means for pivotally connecting said link means with said cylinder-piston unit, so that during the extension and retraction of said piston rod said cylinder of said cylinder-piston unit moves along an arc.

11. A fluid-operated wrench as defined in claim 10, wherein said lever means includes a lever which has one end pivotally connected with said link means and another end, and a further link which is fixedly connected with said piston rod and has a guide in which said other end of said first mentioned link is slidably guided.

12. A fluid-operated wrench as defined in claim 4; and further comprising means for retaining said free end of said piston rod in abutment against said one object and releasing said free end of said piston rod from said one object, said releasing and retaining means including a spring arranged to urge said piston rod toward the abutment and a pressure medium supply container arranged to supply pressure medium so as to hold said piston rod in the abutment against said one object and to withdraw the pressure medium back into said container for releasing the pressure from said piston rod and therefore allowing its withdrawal from said one object.

13. A fluid-operated wrench as defined in claim 3; and further comprising a reaction member connected with said piston and arranged to abut against said one object; and guide means guiding said reaction member and connected with said cylinder-piston unit and formed circumferentially so that during extension and retraction of said piston rod an abutment area of said reaction member against said one object does not change its position.

* * * * *